US007648325B2

(12) United States Patent
Schottke

(10) Patent No.: US 7,648,325 B2
(45) Date of Patent: Jan. 19, 2010

(54) INDUSTRIAL TRUCK

(75) Inventor: Carsten Schottke, Moosburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 172 days.

(21) Appl. No.: 11/363,273

(22) Filed: Feb. 28, 2006

(65) Prior Publication Data

US 2006/0245893 A1 Nov. 2, 2006

(30) Foreign Application Priority Data

Mar. 1, 2005 (DE) ..... 10 2005 009 361

(51) Int. Cl.
*B66F 9/14* (2006.01)

(52) U.S. Cl. ..... 414/666; 414/633; 187/222; 180/89.13

(58) Field of Classification Search ..... 414/632, 414/633, 637, 665, 666, 669, 670, 550; 180/89.13; 187/222, 227, 238
See application file for complete search history.

(56) References Cited

U.S. PATENT DOCUMENTS 2,143,983 A * 1/1939 Howell ..... 180/54.1
2,753,066 A * 7/1956 Arnot ..... 414/633
3,166,209 A * 1/1965 Haddock, Jr. ..... 414/670
3,572,530 A * 3/1971 Ohntrup et al. ..... 414/666
3,601,169 A * 8/1971 Hamilton et al. ..... 144/34.1
3,659,733 A * 5/1972 Sinclair et al. ..... 414/670
3,937,346 A * 2/1976 van der Laan ..... 414/666
3,998,346 A * 12/1976 Gibson et al. ..... 414/666
4,218,170 A * 8/1980 Goodacre ..... 414/666
4,499,971 A * 2/1985 Luebrecht et al. ..... 187/223
4,636,131 A * 1/1987 Sinclair ..... 414/621
4,881,865 A * 11/1989 Herolf ..... 414/550
5,011,363 A * 4/1991 Conley et al. ..... 414/666
5,036,952 A * 8/1991 Harper ..... 187/238
5,044,472 A 9/1991 Dammeyer et al.
5,143,180 A 9/1992 Harper (Continued)

FOREIGN PATENT DOCUMENTS

DE 30 17 456 C2 11/1981

(Continued)

OTHER PUBLICATIONS

European Search Report for EP 06/00/3988 (Jun. 7, 2006).

(Continued)

*Primary Examiner*—James Keenan
(74) *Attorney, Agent, or Firm*—Nixon & Vanderhye P.C.

(57) ABSTRACT

An industrial truck, in particular a stacker vehicle, having a mobile base, a cab, which can be moved in relation to the mobile base, for an operator, a load-receiver and a device, which is arranged on the mobile base, for moving the load-receiver in relation to the mobile base, wherein the device for moving the load-receiver has a multiple-element articulated arm as a support, which can be moved in a controllable manner, for the load-receiver, and wherein the articulated arm, starting from a base-side articulation point beneath the cab or starting from a base-side articulation point above the cab, extends to the load-receiver, the elements of the articulated arm being connected to one another by pivot bearings—and being capable of being moved in relation to one another in order to manipulate the load-receiver.

14 Claims, 12 Drawing Sheets

U.S. PATENT DOCUMENTS

| | | | | |
|---|---|---|---|---|
| 5,178,506 | A | 1/1993 | Meschi | |
| 5,308,216 | A * | 5/1994 | Herolf | 414/550 |
| 5,558,483 | A | 9/1996 | Masuda | |
| 5,599,155 | A | 2/1997 | Rohm et al. | |
| 6,105,699 | A * | 8/2000 | Hinds | 180/89.14 |
| 6,345,694 | B1 * | 2/2002 | Volker | 187/223 |
| 6,564,906 | B1 * | 5/2003 | Haack et al. | 187/222 |
| 7,347,299 | B2 * | 3/2008 | Billger et al. | 180/326 |

FOREIGN PATENT DOCUMENTS

| | | | |
|---|---|---|---|
| DE | 31 49 002 | A1 | 6/1983 |
| DE | 37 19 503 | A1 | 12/1988 |
| DE | 42 18 416 | C2 | 12/1993 |
| DE | 195 17 804 | C2 | 11/1995 |
| EP | 0 949 190 | A2 | 10/1999 |
| EP | 1 258 451 | A2 | 11/2002 |
| JP | 62-4199 | | 2/1987 |
| JP | 62-41199 | | 2/1987 |
| JP | 2002-087771 | | 3/2002 |
| JP | 2002-87771 | | 3/2002 |
| NL | 1007308 | | 4/1999 |

OTHER PUBLICATIONS

German Search Report.

* cited by examiner

INDUSTRIAL TRUCK

BACKGROUND OF THE INVENTION

The invention relates to an industrial truck, in particular a stacker vehicle, having a mobile base, a cab, which can be moved in relation to the mobile base, for an operator, a load-receiving means and a device, which is arranged on the mobile base, for moving the load-receiving means in relation to the mobile base.

Industrial trucks of the abovementioned type have been implemented in various embodiments, for example as high-reach stackers, order picker trucks or trilateral stackers. A current design for such a conventional order picker truck or trilateral stacker comprises a mobile base (base vehicle) having a mast, which is provided for the purpose of lifting and lowering a platform with a driver's cab. An add-on device, which comprises a so-called pivot-and-reach device for a load-receiving means, is fixed to the front of the driver's cab. The pivot-and-reach device has a load-receiving means holder, which can be moved vertically on an additional mast and can be pivoted, together with the additional mast, about a vertical pivot axis in order to vertically displace the load-receiving means, for example a load-bearing fork, and in order to orient it in the straight-on direction of travel of the mobile base or transversely thereto. The additional mast is fixed to a lateral reach carriage, which can be displaced on a linear guide transversely with respect to the straight-on direction of travel of the base vehicle. The load-receiving means therefore has a plurality of degrees of freedom in movement in relation to the base vehicle, namely a vertical degree of freedom in movement (main lifting and, if appropriate, additional lifting), a horizontal degree of freedom in movement in the direction transverse with respect to the straight-on direction of travel of the base vehicle and a degree of freedom in pivoting movement about the vertical pivot axis of the additional mast. The degrees of freedom in movement can be utilized, for example, in a high-reach, narrow-aisle warehouse in order to stack or remove pallets in or from shelves provided on both sides of the aisle traversed by the base vehicle and, if appropriate, in order to order-pick individual articles from the shelf. Such vehicles usually have an electric motor as the traction drive, which is supplied with electrical power from an on-board battery. A hydraulic system is usually used as the drive for the lifting, the lateral reaching and the pivoting movements of the load-receiving means. Such stacker vehicles have proven to be successful in a wide variety of uses, in particular in a standard shelf storage environment with aisle widths which are matched to the radii of action of the industrial truck.

SUMMARY OF THE INVENTION

An industrial truck has been developed, in particular an order picker truck, which is suitable for a broader range of applications with more diverse options for load handling compared with conventional industrial trucks.

Preferably, the device for moving the load-receiving means in relation to the mobile base has a multiple-element articulated arm as a support, which can be moved in a controllable manner, for the load-receiving means, and that the articulated arm, starting from a base-side articulation point beneath the cab or starting from a base-side articulation point above the cab, extends to the load-receiving means, the elements of the articulated arm being connected to one another by means of pivot bearings—and being capable of being moved in relation to one another in order to manipulate the load-receiving means.

In an industrial truck of the type mentioned initially having a multiple-element robot arm as the manipulating means for pallets or the like, the robot arm may be arranged in a manner which is optimized with respect to the space requirement. Owing to the fact that the base-side articulated arm elements are arranged beneath the cab platform, it is possible for the load-receiving means to be moved very close to the cab, if required, with the result that an operator standing in the cab has convenient access to a pallet or the like which is borne by the load-receiving means. In this case, depending on the embodiment of the industrial truck, at least one proximal articulated arm element beneath the cab platform can be brought into a retracted position such that it does not take up any space between the cab and the load-receiving means. This also applies to multiple-element articulated arms having a relatively great reach. This also applies to an embodiment in which the relevant articulated arm elements are arranged above the cab.

In preferred exemplary embodiments, the entire articulated arm extends at the height level beneath the driver's cab or at the height level above the driver's cab, with the result that it cannot form a disruptive lateral contour between the load and the cab for an operator in the cab.

In one particular embodiment, an industrial truck could have an articulated arm which is articulated beneath the cab and an articulated arm which is articulated above the cab, which articulated arms preferably hold a common load-receiving means at their distal ends.

The multiple-element articulated arm is preferably arranged on a mast such that it can move essentially vertically, with the result that it can be positioned in various lifting positions by means of a lifting device on the mast, to be precise preferably together with the driver's cab, which can be arranged, for example, directly above the articulated arm or directly beneath the articulated arm.

In accordance with one preferred embodiment, the articulated arm is articulated on the lifting device such that it can be pivoted about a normally vertical pivot axis by means of a main pivot bearing arrangement, with the result that it can carry out pivoting movements in the horizontal plane of its respective lifting position. The pivoting movements of the articulated arm elements take place in a controlled and coordinated manner by means of a control device in order, for example, to implement essentially straight displacement movements of the load-receiving means, for example of a load-bearing fork. In this case, in particular uniform and gentle movement sequences can be achieved. One advantage of such an industrial truck is the fact that the multiple-element articulated arm enables the load-receiving means to have a greater reach when it is moved in relation to the mobile base, it being possible for the load-receiving means to be positioned, moreover, in a more flexible manner, owing to the multiple-element articulated arm being pivoted in an appropriate manner, than is the case with order picker trucks and trilateral stackers of the conventional type.

One development provides for a load-receiving means holder, which bears the load-receiving means, to be arranged such that it can pivot by means of an outer pivot bearing arrangement at the free end of the articulated arm, the outer pivot bearing arrangement making it possible for the load-receiving means holder to be pivoted about a normally vertical pivot axis. The load-receiving means holder may have an additional mast, on which the load-receiving means is guided such that it can be displaced vertically. Such an additional lifting function is already known per se from conventional order picker trucks and trilateral stackers.

The pivot bearings, which connect the elements of the articulated arm to one another, preferably have essentially vertical pivot axes. In modified refinements of the invention, provision may also be made for at least one articulated arm element to be mounted such that it can pivot upwards and downwards.

In order to avoid a complicated design, the articulated arm has preferably merely two articulated arm elements. In this case, provision may be made for at least one of the articulated arm elements to be arranged such that it can be longitudinally displaced in relation to the pivot bearing, which holds it such that it can pivot, on said pivot bearing, or to be capable of being telescoped. The articulated arm element arranged on the lifting device directly by means of the main pivot bearing arrangement is preferably guided such that it can be longitudinally displaced in relation to the main pivot bearing arrangement, with the result that it can carry out mutually overriding movements of pivoting about the pivot axis and displacement transverse with respect to the pivot axis of the main pivot bearing arrangement. This makes it possible to carry out mutually overriding movements of pivoting and displacement in order to produce a specific, in particular linear movement sequence for the load-receiving means.

In the respective lifting position, the load-receiving means can preferably be positioned in a lateral alignment position, in which it in any case protrudes laterally outwards to a minimum extent from the mobile base transversely with respect to the straight-on direction of travel of said mobile base and is moved up close to the mobile base with an alignment transverse with respect to the straight-on direction of travel of said mobile base, it being possible for the articulated arm to be activated so as to displace the load-receiving means laterally outwards from the alignment position along an at least approximately straight line and so as to move it back into the alignment position again. Such a movement sequence can be used, for example, for laterally stacking or unstacking pallets or the like.

On the other hand, provision may also be made for it to be possible for, in the respective lifting position, the load-receiving means to be positioned in a straight-on alignment position, in which it in any case protrudes laterally outwards to a minimum extent from the mobile base transversely with respect to the straight-on direction of travel of said mobile base, and for said load-receiving means to be oriented in the straight-on direction of travel and moved up close to the mobile base. The pivoting arm can preferably be activated so as to move the load-receiving means forwards out of the straight-on alignment position along an at least approximately straight line—and so as to move it back into the straight-on alignment position again.

If necessary, it is also possible for the pivoting arm to move the load-receiving means obliquely with respect to the straight-on direction of travel of the mobile base or longitudinally curved tracks. These examples already show that the multiple-element articulated arm makes it possible to manipulate the load-receiving means and a load located thereon in a very flexible manner.

In accordance with one variant, provision is made for the movement of the load-receiving means to be capable of being controlled freely in the respective horizontal plane by an actuating element, for example a rotatable joystick or the like. A programmed control device in this case coordinates the movements of the articulated arm elements. In accordance with another variant, provision is made for only specific movement profiles, which are controlled by means of the control device, to be possible.

In accordance with one further embodiment, the main pivot bearing arrangement of the articulated arm is arranged on the lifting device such that it can be displaced transversely with respect to the lifting direction in order to be able to carry out balancing movements of the articulated arm.

One particular feature of one embodiment consists in it being possible for the articulated arm to be activated so as to position the load-receiving means to the side of the mobile base, to be precise such that, in a side view, the load-receiving means and the mobile base overlap one another.

Suitable drive means for moving the pivoting arm elements are, in particular, hydraulic motors and/or electric motors.

In accordance with one preferred embodiment, the articulated arm can, if necessary, be folded in a space-saving manner such that its elements bear virtually parallel against one another.

SUMMARY OF THE DRAWINGS

Exemplary embodiments of the invention will be explained in more detail below with reference to the drawings, in which.

DETAILED DESCRIPTION OF THE INVENTION

Figure 1:
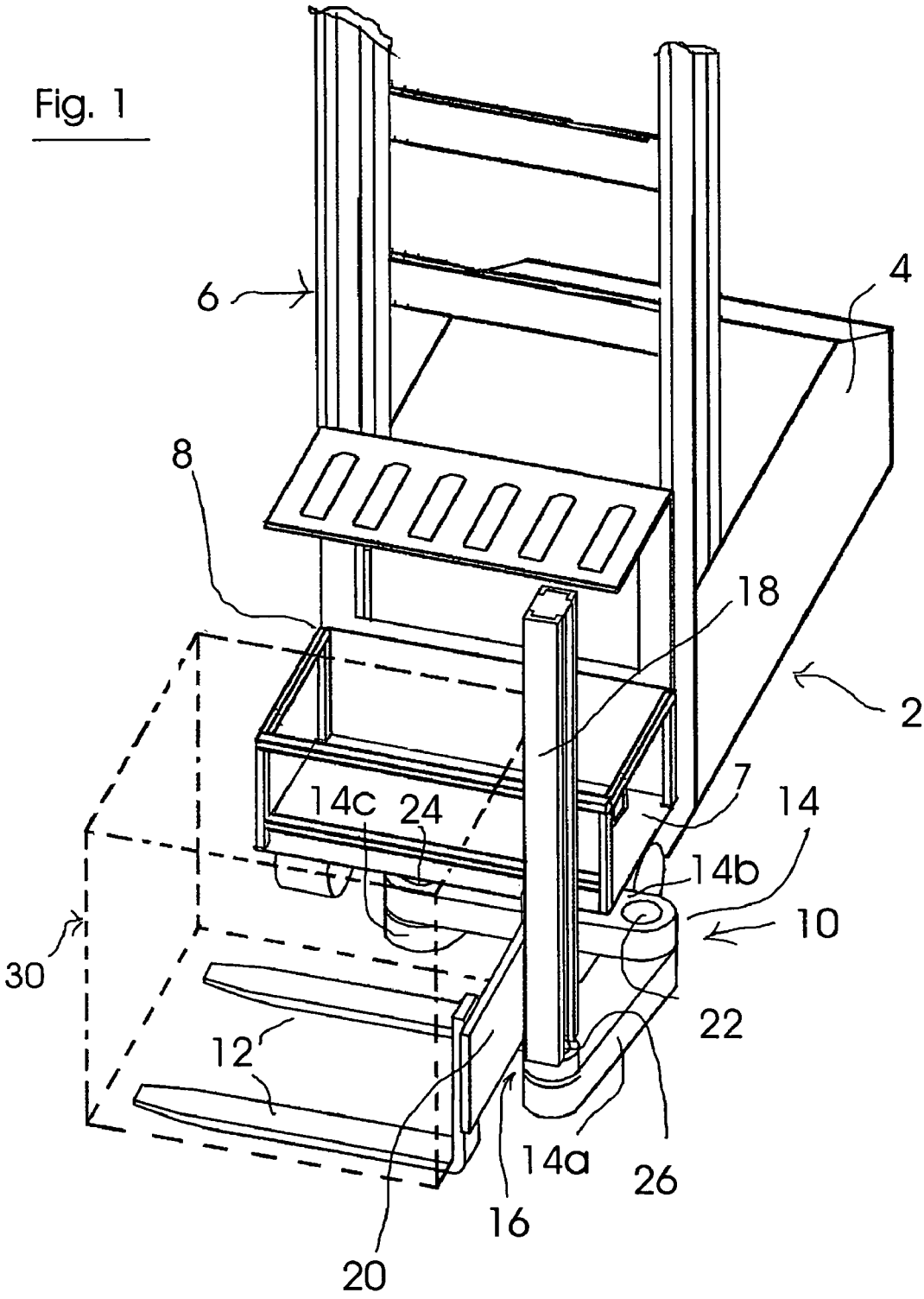
FIG. 1 shows a perspective illustration of a first exemplary embodiment of an industrial truck, which can be used, for example, as a high-reach stacker.

FIG. 1 shows a perspective illustration with a view of the front region of an industrial truck which can be used as a high-reach stacker. The industrial truck has a base vehicle 2, which has an essentially conventional design and has an electric motor drive.

Batteries for supplying the vehicle with electrical power, hydraulic assemblies, parts of the steering device, electronic or electrical components etc. are located beneath the hood 4 in the rear region of the vehicle 2. A mast 6 (illustrated partially) is provided on the base vehicle 2 and, in a known manner, has a rigid lower mast element and an upper mast element which can be displaced vertically and telescopically on said rigid lower mast element, a platform with a driver's cab 8 being guided on said upper mast element such that it can be moved vertically. The lifting drive in this example is hydraulic, as is conventional in the case of stacker vehicles of the type in question here.

The add-on device 10 of the industrial truck shown in FIG. 1, however, differs substantially from the add-on devices of conventional design for order picker trucks and trilateral stackers. In the case of the industrial truck shown in FIG. 1, an articulated arm 14 having articulated arm elements 14*a*, 14*b* and 14*c* is provided as the manipulating device for the load-receiving means 12 in the form of a load-bearing fork. The distal articulated arm element 14*a* bears a load-receiving means holder 16 at its outer end which has an additional mast 18 and a fork holder 20, which can be moved upwards and downwards thereon. The fork prongs of the load-bearing fork 12 are arranged on the fork holder 20. The additional mast 18 can be pivoted about a vertical pivot axis, with the result that the fork prongs of the load-bearing fork 12 can be oriented in different directions in relation to the straight-on direction of travel of the base vehicle 2.

The figures do not show hydraulic cylinder/piston assemblies which act between the articulated arm elements 14*a*, 14*b* and the articulated arm elements 14*b*, 14*c* in order to pivot the articulated arm elements in relation to one another about the vertical pivot axes of the pivot bearings 22, 24 on the basis of the desired movement profile. 26 in FIG. 1 denotes the pivot bearing of the additional mast 18, whose rotation about the vertical pivot axis of the pivot bearing 26 preferably likewise takes place by means of hydraulic drive devices. This also applies to the lifting movements of the fork holder 20.

FIG. 1 illustrates a symbolic load 30 using dashed lines.

Figure 2A:
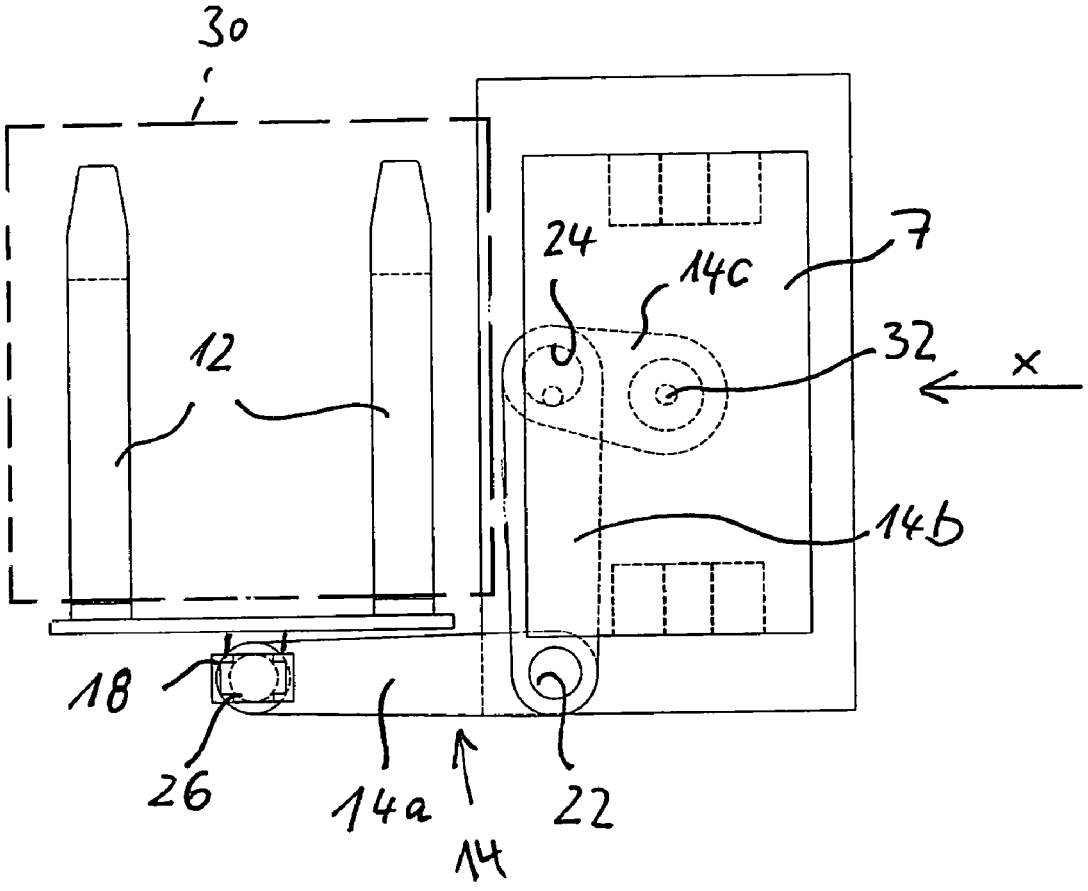
FIGS. 2*a*-2*c* show schematic plan-view illustrations of the add-on device of the industrial truck from FIG. 1 with various positions of the articulated arm.
Figure 2B:
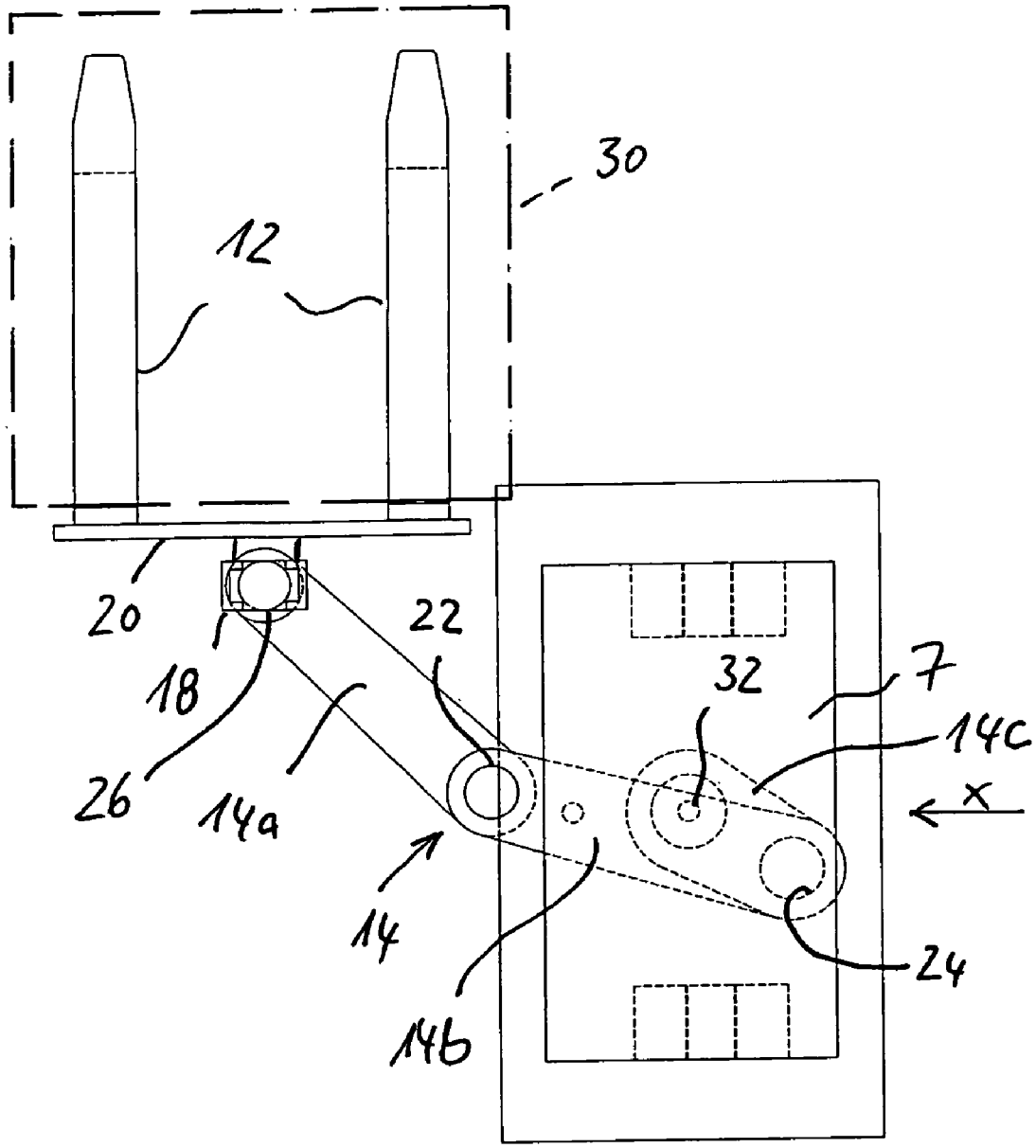
Figure 2C:
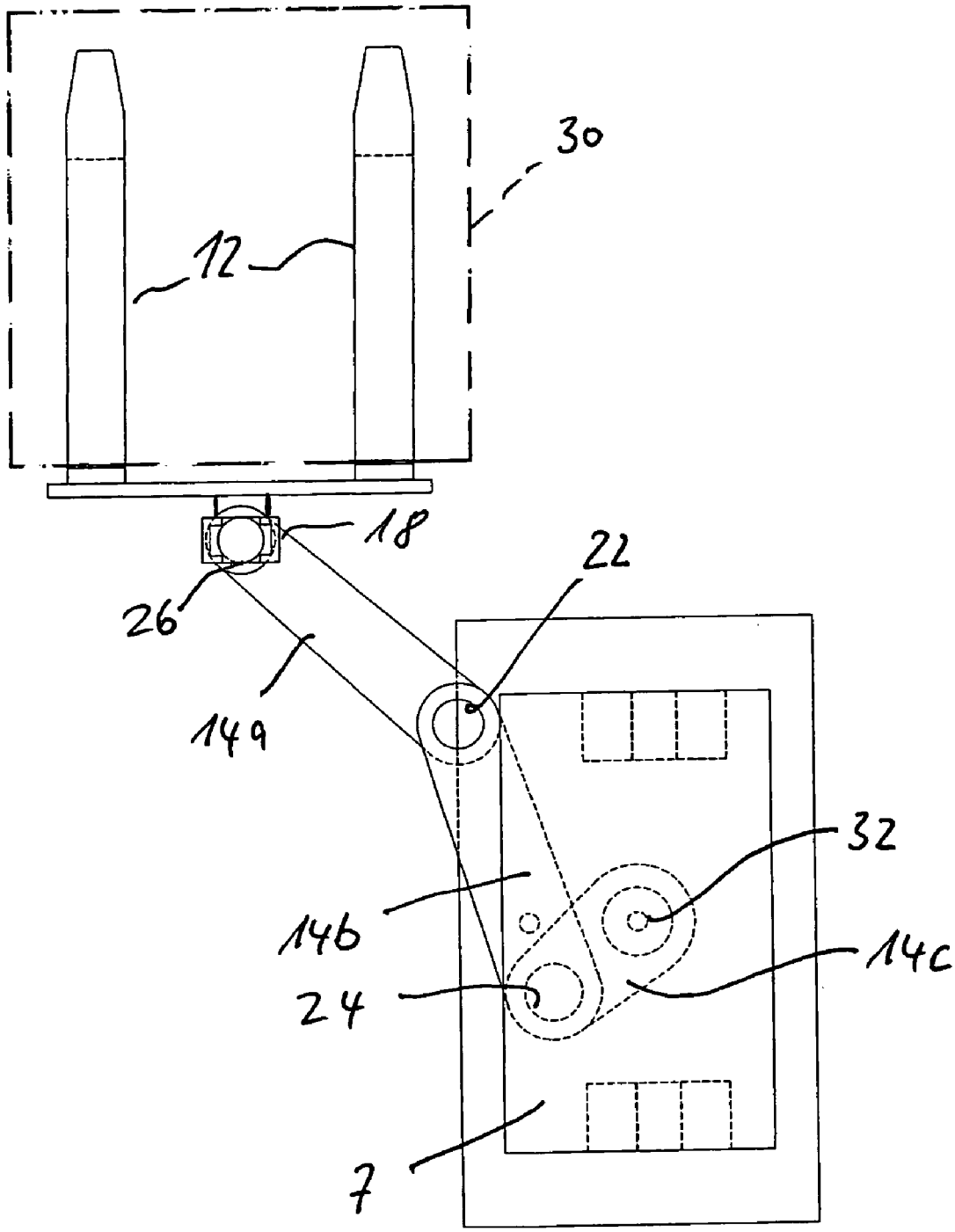

FIGS. 2*a*-2*c* show schematic plan-view illustrations of the add-on device of the industrial truck from FIG. 1, in various snapshots during lateral-reach operation. In order to simplify the illustration, elements of the base vehicle have not been illustrated in FIGS. 2*a*-2*c*. However, the bottom platform 7 of the driver's cab can be seen. The straight-on direction of travel is indicated by an arrow X. In FIG. 2*a*, the load-receiving means 12 is positioned in a lateral alignment position, in which it is positioned in front of the base vehicle, with the result that it only protrudes outwards to a minimum extent laterally over the contour of the base vehicle. In addition, the load-receiving means 12 is moved close to the base vehicle.

Owing to the movement of the articulated arm 14, the load-receiving means 12 can be pushed laterally out of the position shown in FIG. 2*a* along an essentially straight line, for example in order to stack the load 30 on a shelf. FIG. 2*b* shows an intermediate step of such lateral reaching.

The main pivot bearing 32 holds the articulated arm 14 on the lifting device (not shown in FIGS. 2*a*-2*c*) and defines the vertical pivot axis for the articulated arm element 14*c*. The angular adjustments of the articulated arm elements 14*a*, 14*b*, 14*c* in relation to one another and in relation to the base vehicle are carried out in a controlled manner by correspondingly controlling the hydraulic adjustment devices (not shown) on the basis of the movement profile selected by the driver by means of an actuating device. The actuating device and the control device provided for the purpose of controlling the movement sequences of the load-receiving means are not illustrated in the drawings.

As can be seen in particular in FIG. 2*c*, the articulated arm 14 has a relatively great reach, when viewed from the stationary base vehicle. It can thus push the load-receiving means, if required, comparatively deep into a lateral shelf compartment.

However, the articulated arm 14 not only makes possible lateral-reach movements of the load-receiving means 12 but also a large number of other movement sequences and alignments of the load-receiving means 12. The industrial truck according to the invention is thus in particular also suitable for order picking tasks or sorting tasks in non-standardized shelf storage environments.

Figure 3:
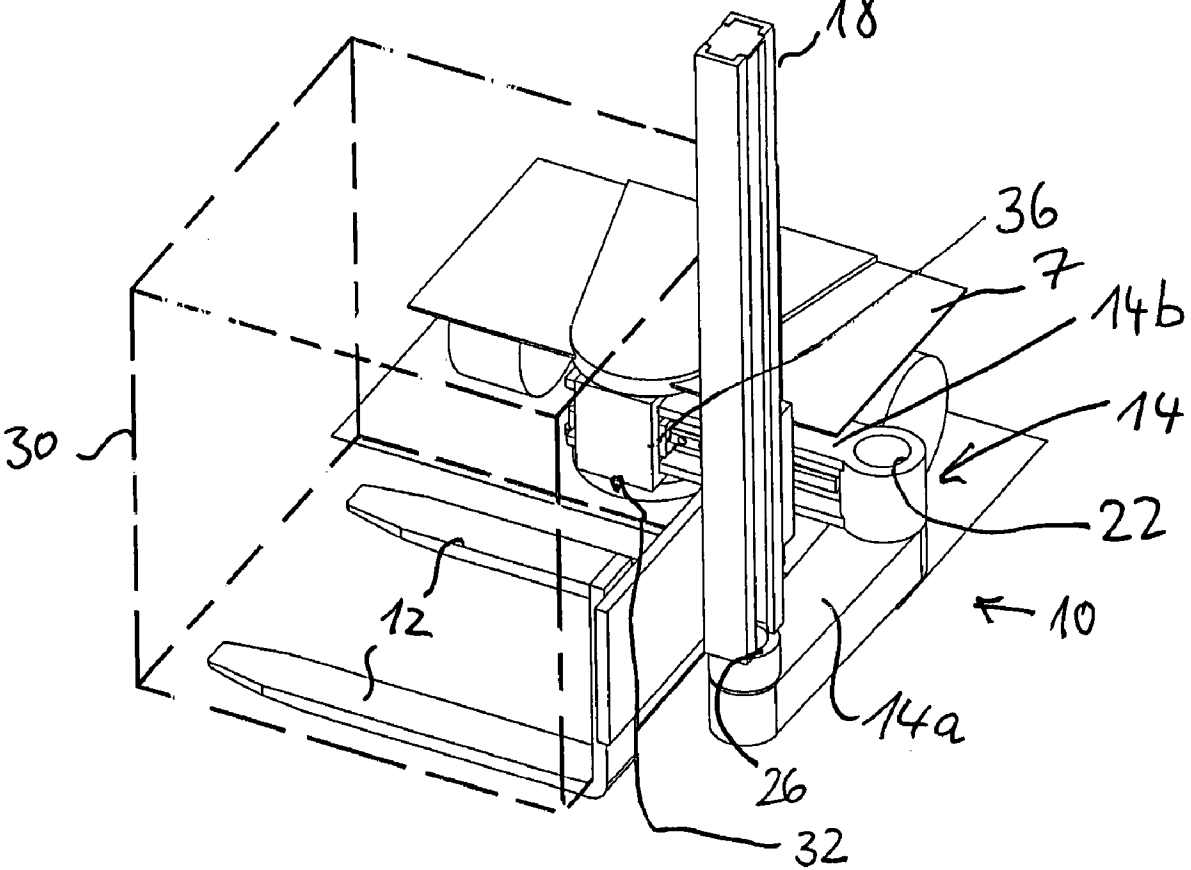
FIG. 3 shows a perspective view, similar to that in FIG. 1, of the add-on device of a second exemplary embodiment.

FIG. 3 shows a perspective illustration of the add-on device of a second exemplary embodiment. Elements in FIG. 3 which correspond in terms of design or function to the elements in FIG. 1 or FIGS. 2*a*-2*c* are identified by respectively corresponding reference symbols such that the following explanations can essentially be restricted to the differences between the second exemplary embodiment and the first exemplary embodiment.

In the second exemplary embodiment shown in FIG. 3, the articulated arm 14 comprises two articulated arm elements 14*a*, 14*b*. The articulated arm element 14*b* can be longitudinally displaced in relation to the guide cage 36, which is mounted on the lifting device such that it can rotate by means of the main pivot bearing, by means of a linear guidance of said guide cage 36 and can be pivoted about the vertical pivot axis of the main pivot bearing 32 together with the guide cage 36. The drive for the longitudinal displacement of the articulated arm element 14*b* in relation to the guide cage 36 may be, for example, a hydraulic and/or an electric drive.

FIGS. 4*a*-4*d* illustrate plan-view illustrations of snapshots of different movement sequences of the load-receiving means 12. As in FIGS. 2*a*-2*c*, elements of the base vehicle are not illustrated in FIGS. 4*a*-4*d*.

Figure 4A:
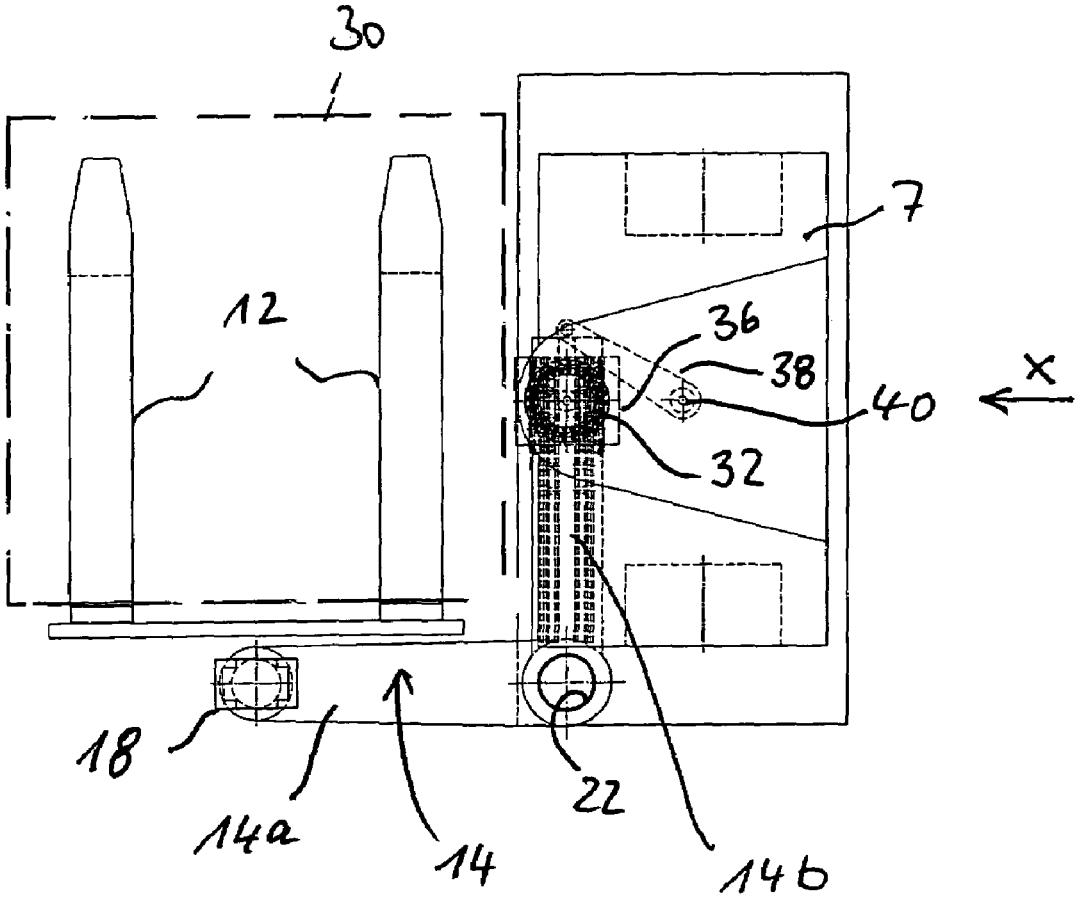
FIGS. 4*a*-4*d* show the add-on device from FIG. 3 in plan-view illustrations with various positions of the articulated arm.

FIG. 4*a* shows the load-receiving means 12 in a position which corresponds to the position of the load-receiving means 12 in FIG. 2*a*. The articulated arm elements 14*a* and 14*b* are approximately orthogonal with respect to one another, the articulated arm element 14*b* being in its maximum extended position in relation to the guide cage 36.

Figure 4B:
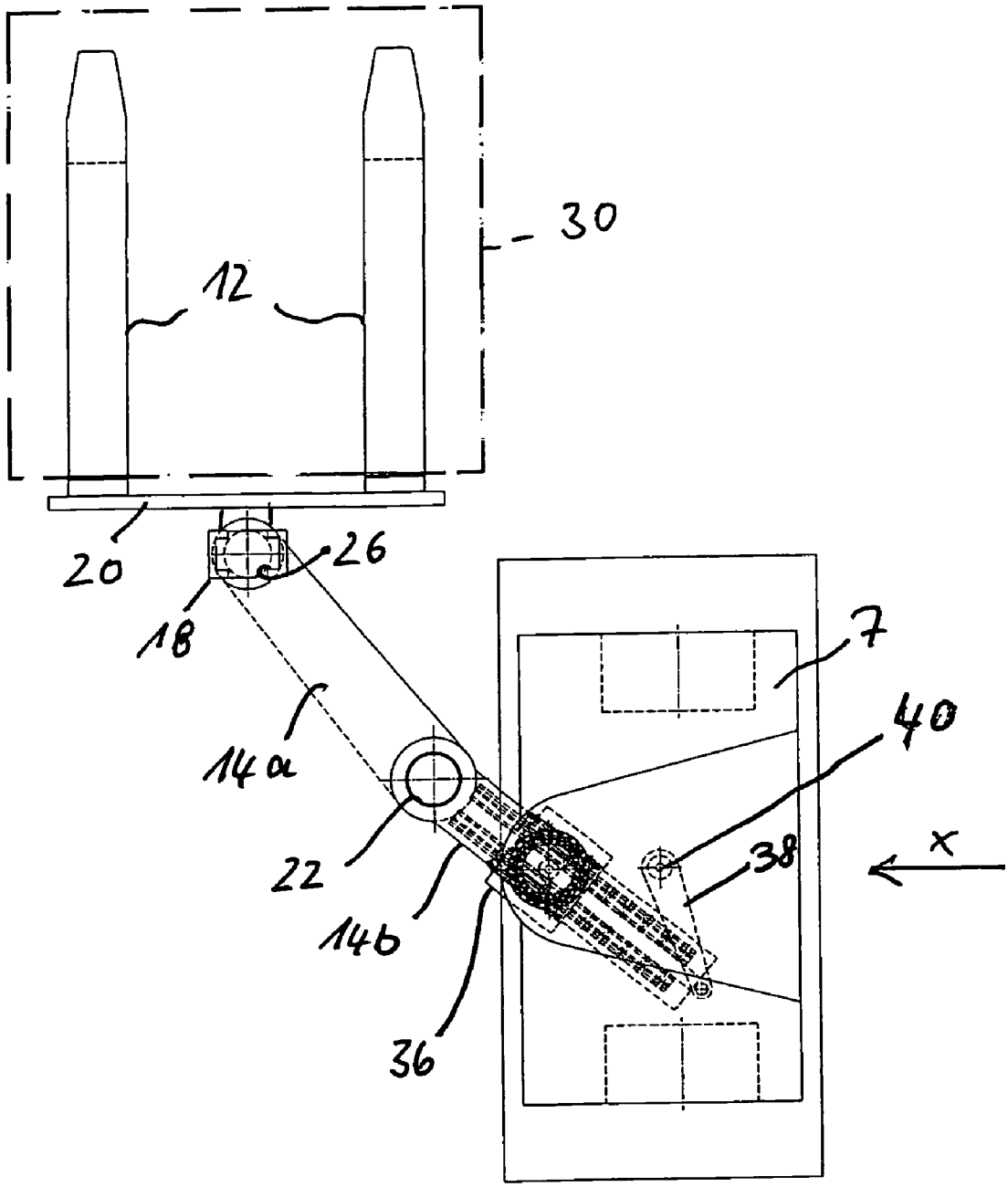

FIG. 4*b* shows the load-receiving means 12*b* during a lateral-reach operation along an essentially straight line, starting from the situation shown in FIG. 4*a*.

When moving from the situation shown in FIG. 4*a* to the situation shown in FIG. 4*b*, the articulated arm 14 experiences a pivoting movement about the vertical pivot axis of the main pivot bearing 32. In addition, the articulated arm element 14*b* is retracted further in relation to the guide cage 36. The displacement of the articulated arm element 14*b* in relation to the guide cage 36 takes place by means of a crank 38, which is mounted at 40 such that can rotate about a vertical axis of rotation.

Even in the second exemplary embodiment, the respective angular adjustment of the articulated arm elements 14*a*, 14*b* in relation to one another or in relation to the base vehicle takes place under the control of a control device and on the basis of the movement profile of the load-receiving means which was previously selected by the driver by means of an actuating device.

Figure 4C:
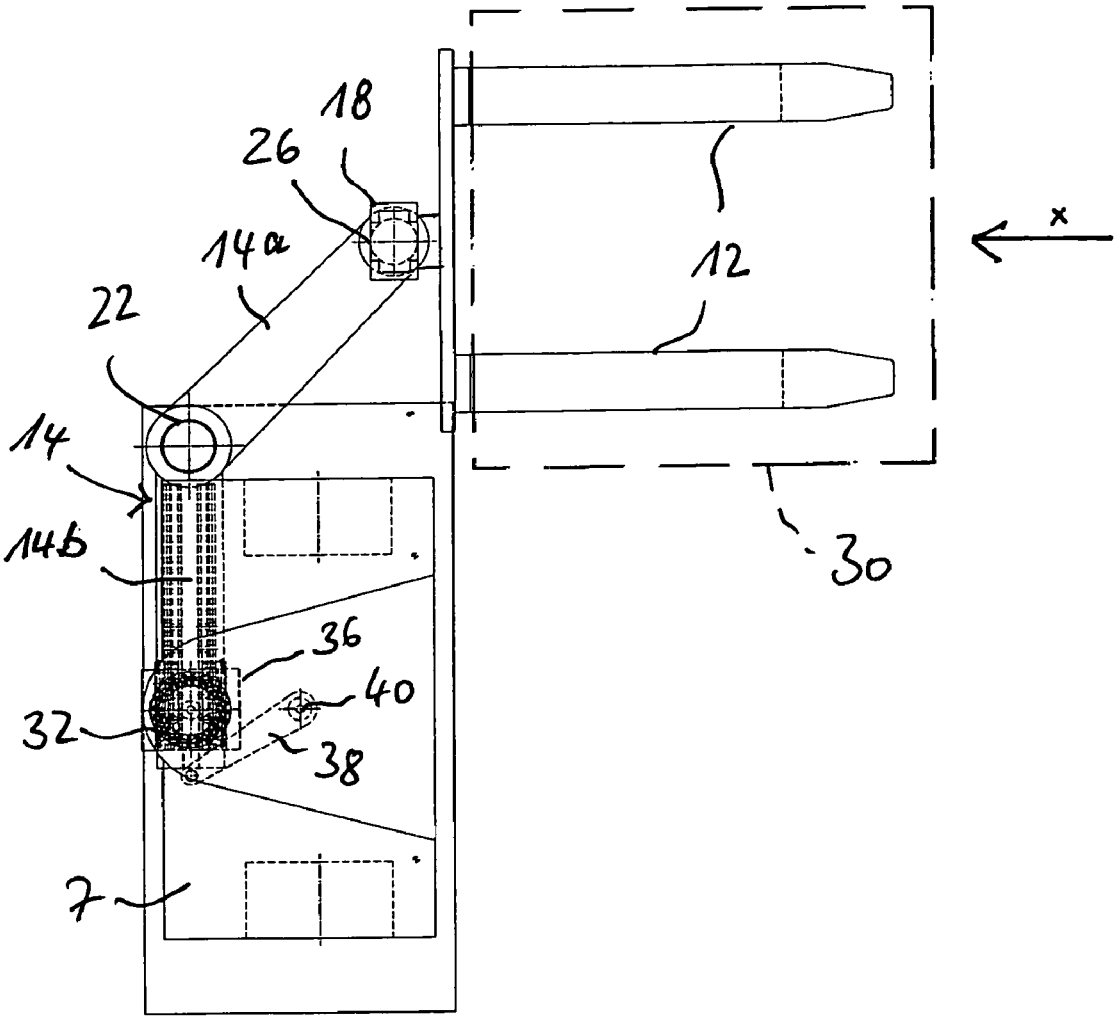

FIG. 4*c* illustrates an operating situation of the industrial truck according to the invention which cannot be realized by conventional stacker vehicles of the type under consideration here. In accordance with the operating situation shown in FIG. 4*c*, the load-receiving means 12 has been positioned to the side of the industrial truck, for example in order to set down or pick up a load.

Figure 4D:
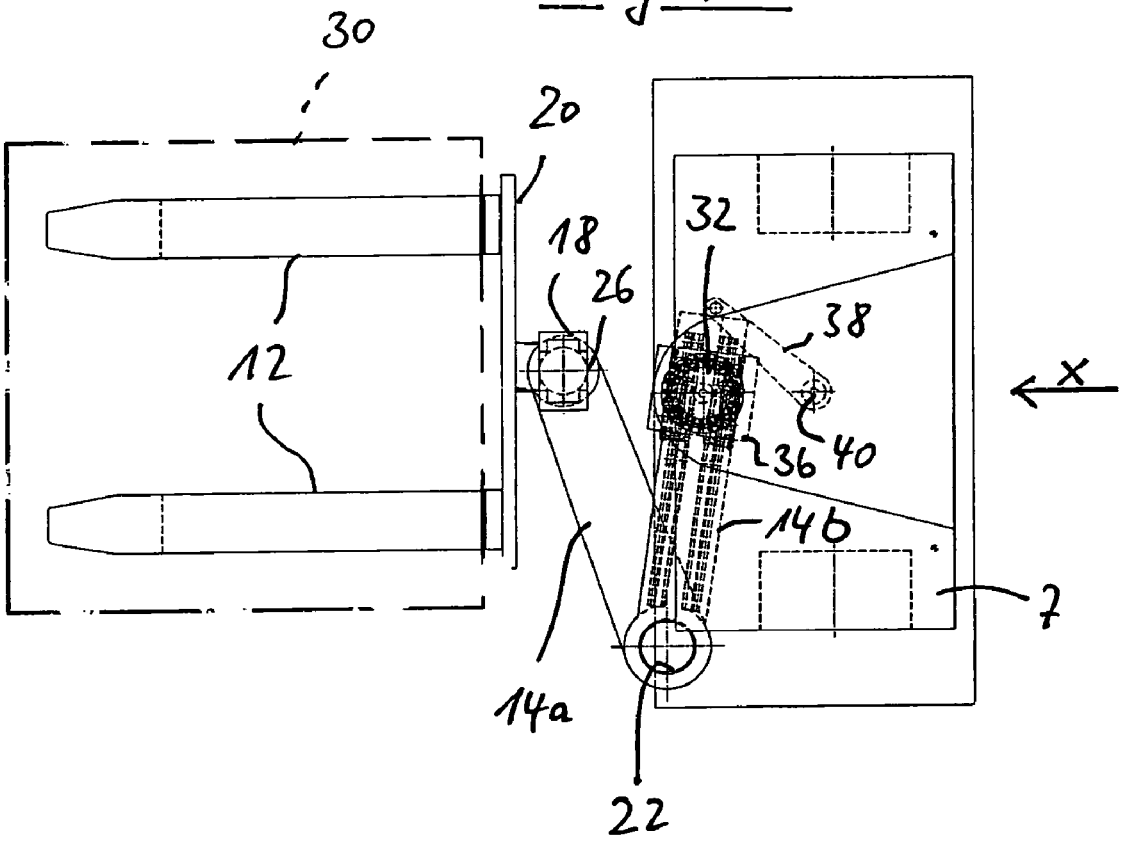

FIG. 4*d* shows an operating situation in which the load-receiving means is oriented in the forward direction of travel of the base vehicle and is moved close to the base vehicle. Starting from the situation shown in FIG. 4*d*, the load-receiving means 12 can now be moved forwards and back again in a straight line (or if necessary following curved tracks) in order to manipulate a load. In this case too, the great reach of the articulated arm 14 can be utilized in an advantageous manner.

Figure 5:
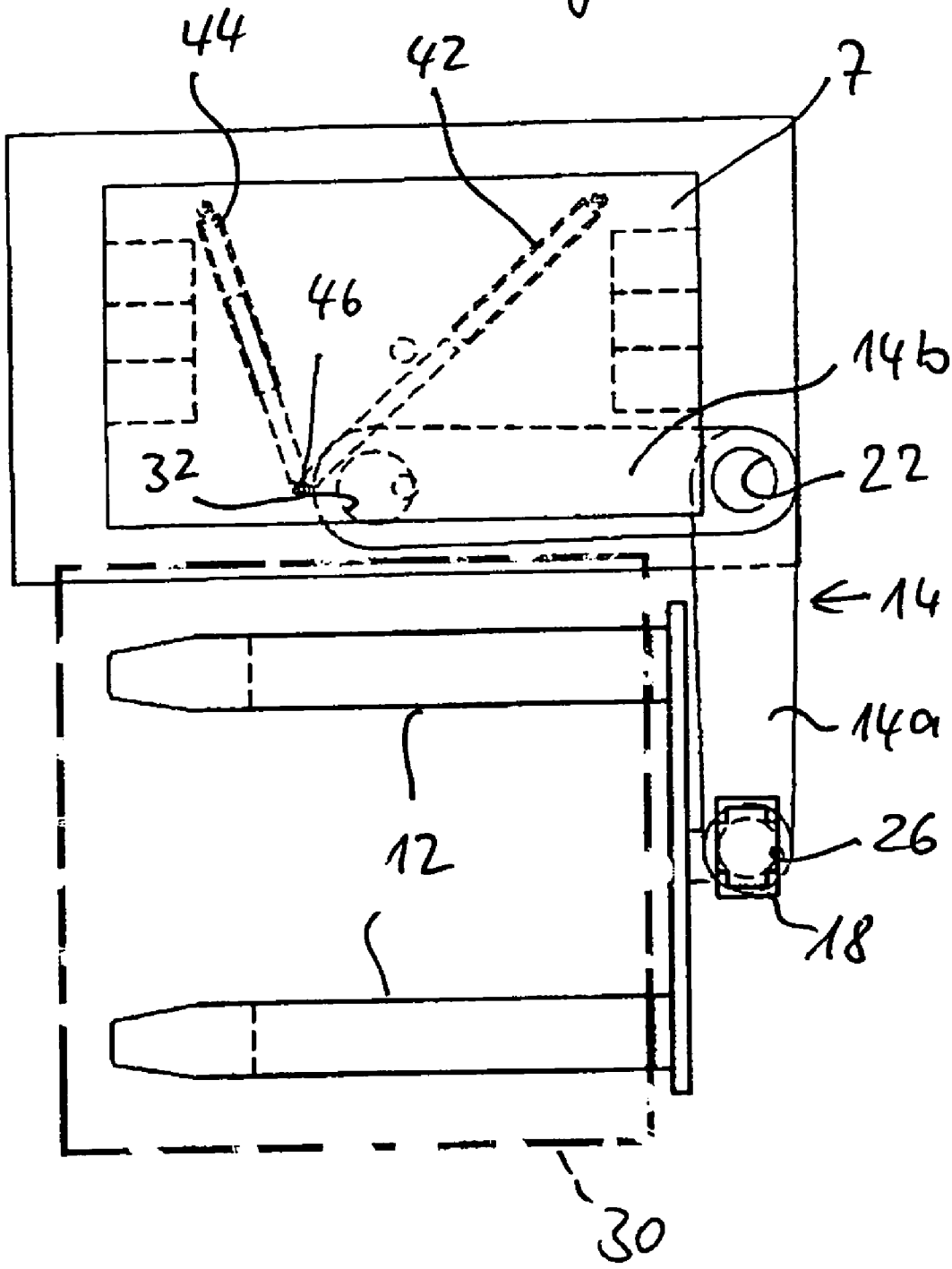
FIG. 5 shows a schematic plan-view illustration of the add-on device of a third exemplary embodiment of an industrial truck.

FIG. 5 shows a schematic plan view of an add-on device of a third exemplary embodiment. The add-on device shown in FIG. 5 has an articulated arm 14 having two articulated arm elements 14*a* and 14*b*. The particular feature of the exemplary embodiment shown in FIG. 5 is the fact that the main pivot bearing 32 can be displaced in a respective X-Y lifting plane in order to be able to carry out balancing movements of the articulated arm 14. The displacement drive used is two cylinder/piston assemblies 42, 44, which are arranged such that they are articulated on the relevant lifting device and are articulated, with their piston rod sides, at 46 on the main pivot bearing. Depending on the extended position of the piston rods of the cylinder/piston arrangements 42, 44, a specific position of the main pivot bearing 32 in the X-Y plane results.

Figure 6:
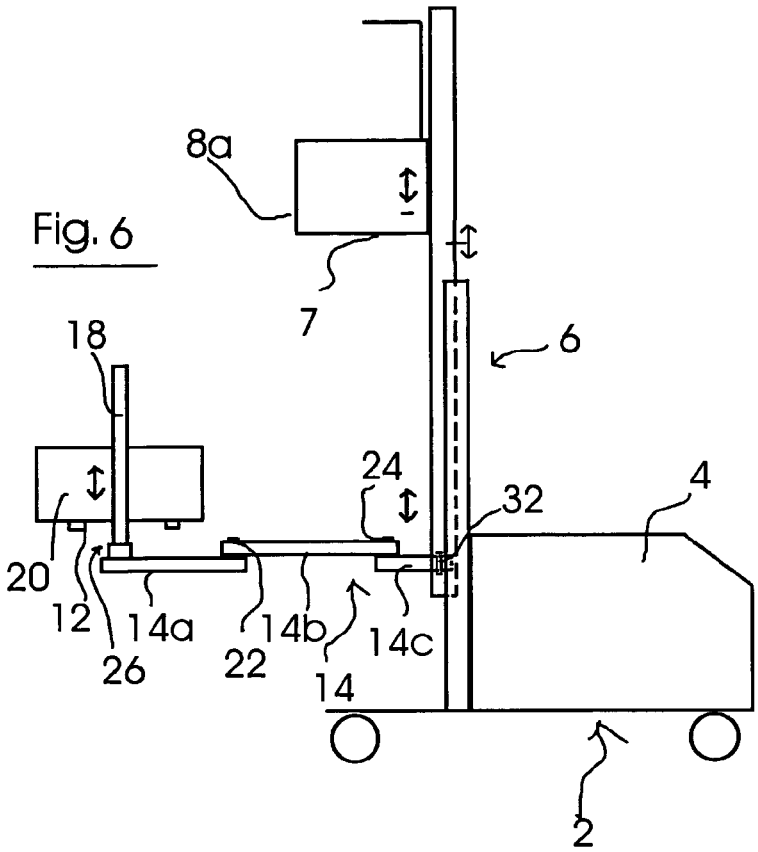
FIG. 6 shows a schematic illustration of the side view of a further exemplary embodiment of an industrial truck.
Figure 7:
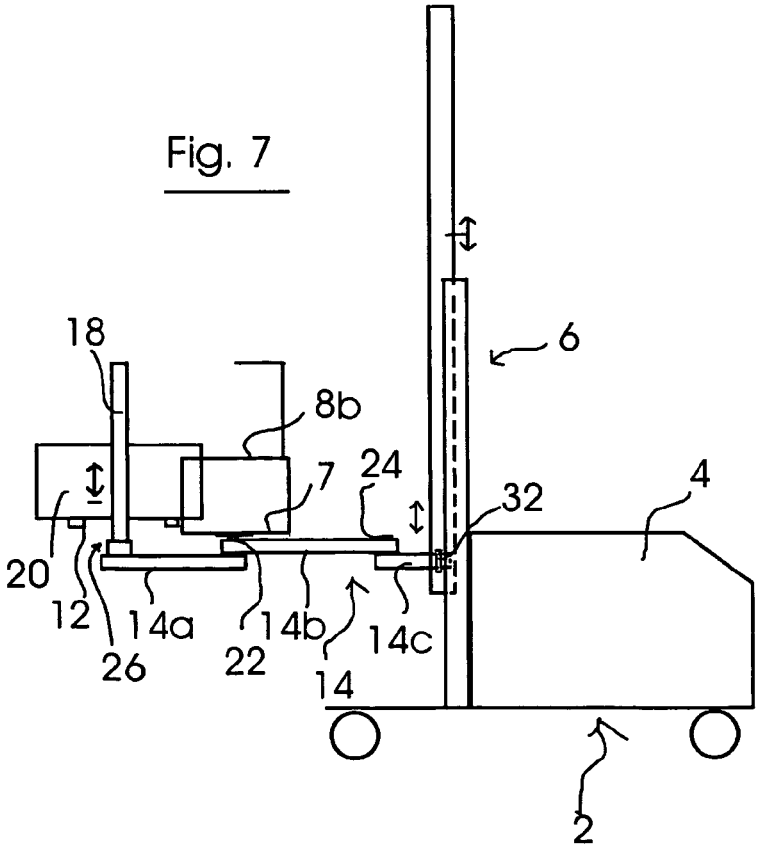
FIG. 7 shows a schematic side view of a further exemplary embodiment of an industrial truck.

In the exemplary embodiment shown in FIG. 6, the cab 8*a* is provided separately from the articulated arm 14 such that it can move on the mast 6, to be precise preferably on the upper mast part which can be extended in a telescopic manner. An operator in the cab 8*a* can thus carry out exploratory journeys with the cab 8*a* in a respective height difference range without the articulated arm 14 and the load supported thereon likewise needing to be moved as well. This can make power-saving operation possible in various working situations. One disadvantage of this, however, is an increased design complexity, which concerns the drive devices for the separate vertical drive of the cab 8*a*. The idea of the separate vertical movement possibility of the cab 8*a* in relation to the load-holding arrangement can also be used for standard order picker trucks or the like. The exemplary embodiment shown in FIG. 7 is a variant with the particular feature that the cab 8*b* is arranged on the articulated arm 14 such that it can be moved away from the mast 6 or towards the mast 6 owing to the movement of the articulated arm 14. An operator in the cab 8*b* thus always remains closer to the load-receiving means 12 even when the articulated arm 14 is extended. The principle of the arrangement of the articulated arm elements 14*a*, 14*b*, 14*c* beneath the cab 8*b* is also maintained in the exemplary embodiment shown in FIG. 7.

Figure 8:
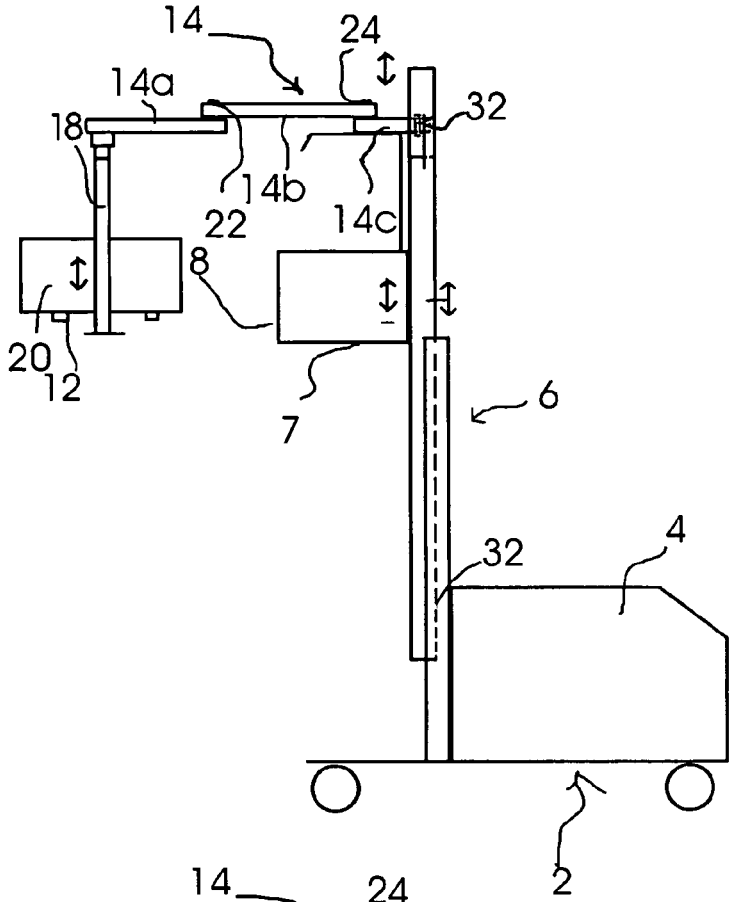
FIG. 8 shows a schematic side view of a further exemplary embodiment of an industrial truck.

In the example shown in FIG. 8, the articulated arm 14 extends above the cab 8, in which case a suspended arrangement of the additional mast 18 is provided.

Figure 9:
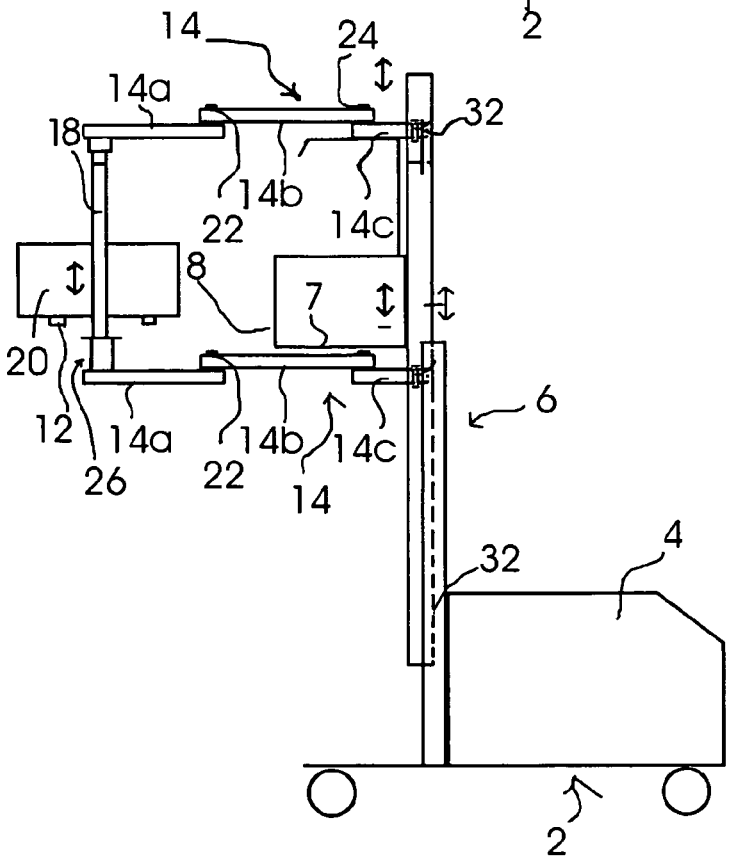
FIG. 9 shows a schematic side view of a further exemplary embodiment of an industrial truck according to the invention.

In the exemplary embodiment shown in FIG. 9, in each case one articulated arm 14 is provided above the cab 8 and one articulated arm 14 is provided beneath the cab 8, the articulated arms 14 holding the additional mast 18 with the load-receiving means 12 at their distal ends. Also conceivable in the context of the invention would be a variant in which the cab is arranged on an articulated arm at its distal end, whereas the load-holding means is provided on the other articulated arm at its distal end, it being possible for the two articulated arms to carry out different pivoting movements corresponding to the way in which they are driven.

In the exemplary embodiments explained above with reference to the drawings, the articulated arm elements 14*a*, 14*b* are arranged in planes beneath or above the cab platform 7. An operator in the cab can thus, if required, conveniently gain access to the load 30 without being impeded by disruptive add-ons.

The industrial truck can be implemented with a comparatively favorable weight distribution and allows for a relatively large cab depth.

Embodiments of the invention in which the articulated arm can also be pivoted in vertical planes in order to carry out load-lifting operations have not been explained in detail. Variants of such embodiments manage without an additional mast and/or without a main mast.

The invention claimed is:

1. A stacker vehicle comprising:

a mobile base, an operator cab, a load-receiver, and a device moving the load receiver in relation to the mobile base, wherein said device includes:

a mast, a lifting device on which the cab is arranged, wherein the lifting device is supported by the mast and guided for vertical movement along the mast, a main pivot bearing arrangement, and a multi-element articulating arm supporting and moving the load-receiver in relation to the mobile base, wherein said multi-element articulating arm is articulated on the mast by said main pivot bearing arrangement to pivot about a normally vertical pivot axis of said main pivot bearing arrangement, wherein arm elements of said multi-element articulating arm are pivotably connected to one another by respective pivot bearings each having a vertical pivot axis such that the arm elements are movable in relation to one another to manipulate the load receiver and a proximal arm of said arm elements is attached to said main pivot bearing, and wherein the normally vertical pivot axis of said main pivot bearing arrangement is in alignment with the cab, and wherein the cab is above an articulation point of the main pivot bearing arrangement and above at least a portion of the proximal arm.

2. The stacker vehicle as claimed in claim 1, wherein the arm elements of the articulating arm are all at a height level beneath the cab.

3. The stacker vehicle as claimed in claim 1, wherein the cab is coupled to the articulating arm to move vertically in common with the articulating arm.

4. The stacker vehicle as claimed in claim 1, wherein the lifting device is coupled to the articulating arm and the lifting device is linked to the mast via the articulating arm to allow movement away from the mast and towards the mast based on the movement of the multi-element articulating arm.

5. The stacker vehicle as claimed in claim 1, wherein said device for moving the load receiver comprises a load-receiver holder supporting the load-receiver, wherein said load-receiver holder is arranged to pivot by an outer pivot bearing arrangement at a free end of the multiple-element articulating arm.

6. The stacker vehicle as claimed in claim 5, wherein the outer pivot bearing arrangement allows the load-receiver holder to be pivoted about a normally vertical pivot axis.

7. The stacker vehicle as claimed in claim 5, wherein the load-receiver holder has an additional mast on which the load-receiver is guided for vertical displacement.

8. The stacker vehicle as claimed in claim 1, wherein the articulating arm has at least two arm elements, one of which is the proximal arm.

9. The stacker vehicle as claimed in claim 1, wherein the proximal arm of the multi-element articulating arm is arranged on said main pivot bearing arrangement with a displacement guide that is longitudinally displaced in relation to the pivot bearing.

10. The stacker vehicle as claimed 9, wherein the multi-element articulating arm is guided such that it can be longitudinally displaced in relation to the main pivot bearing arrangement to carry out superimposed movements of pivoting about the vertical pivot axis of the main pivot bearing arrangement and of transverse displacement with respect to the main pivot bearing arrangement.

11. The stacker vehicle as claimed in claim 1 wherein the main pivot bearing arrangement is arranged on the lifting device and is displaced transversely with respect to a lifting direction.

12. The stacker vehicle as claimed in claim 1, wherein the articulating arm is activated to position the load-receiver to a side of the mobile base.

13. The stacker vehicle as claimed in claim 1 wherein a hydraulic cylinder or a piston assembly moves the arm elements.

14. In a stacker vehicle having a mobile base, an operator cab, a load-receiver, and a device moving the load receiver in relation to the mobile base, the device includes:

a mast, a lifting device mounted on the mast and moving substantially vertically along the mast, wherein the cab is fixed to the lifting device and moves with the lifting device along the mast, a main pivot bearing fixed to the lifting device and moving with the lifting device and cab along the mast, wherein the cab and main pivot bearing are aligned vertically and the cab is above the main pivot bearing, and a multi-element articulating arm supported by the main pivot bearing and moveable with the lifting device and cab along the mast, the multi-element articulating arm having a distal section supporting and moving the load-receiver relative to the mobile base, wherein said multiple-element articulating arm pivots about a normally vertical pivot axis of said main pivot bearing, and arm elements of said multi-element articulating arm are pivotably connected to one another by respective pivot bearings each having a normally vertical pivot axis such that the arm elements move in horizontal planes in relation to one another to move the load receiver with respect to the mobile base, wherein a proximal arm of the arm elements is coupled to the main pivot bearing and at least a portion of the proximal arm is below the cab.

* * * * *